United States Patent [19]

Yamada et al.

[11] Patent Number: 4,827,897

[45] Date of Patent: May 9, 1989

[54] FUEL PUMP DRIVING APPARATUS

[75] Inventors: Hirotada Yamada, Kariya; Yoshifumi Ina, Okazaki; Toshio Kondo; Katsushi Kato, both of Kariya, all of Japan

[73] Assignee: Nippondenso Co., Ltd., Kariya, Japan

[21] Appl. No.: 97,659

[22] Filed: Sep. 16, 1987

[30] Foreign Application Priority Data

Sep. 17, 1986 [JP] Japan ..... 61-218737
Oct. 9, 1986 [JP] Japan ..... 61-240426

[51] Int. Cl.[4] ..... F02M 39/00

[52] U.S. Cl. ..... 123/497; 417/200; 417/365; 388/836

[58] Field of Search ..... 123/497, 499, 198 D, 123/198 DB, 495; 417/200, 365; 318/361, 292, 541, 542

[56] References Cited

U.S. PATENT DOCUMENTS

| | | | |
|---|---|---|---|
| 3,310,722 | 3/1967 | Diello | 318/361 |
| 3,497,788 | 2/1970 | Kerrigan | 318/541 |
| 3,536,974 | 10/1970 | Beigl | 318/541 |
| 3,611,094 | 10/1971 | Bischoff | 318/361 |
| 4,013,053 | 3/1977 | Dinkelkamp | 417/200 |
| 4,485,788 | 12/1984 | Hofbauer | 123/497 |
| 4,586,877 | 5/1986 | Watanabe | 417/365 |
| 4,791,905 | 12/1988 | Furuta | 123/497 |

FOREIGN PATENT DOCUMENTS

| | | | |
|---|---|---|---|
| 1093430 | 5/1955 | France | 318/361 |
| 57-99264 | 6/1982 | Japan . | |
| 57-146044 | 9/1982 | Japan . | |
| 0015755 | 1/1983 | Japan | 123/497 |
| 0048767 | 3/1983 | Japan | 123/497 |
| 0048765 | 3/1983 | Japan | 123/497 |
| 59-150970 | 8/1984 | Japan . | |
| 59-150971 | 8/1984 | Japan . | |
| 59-150972 | 8/1984 | Japan . | |
| 59-190464 | 10/1984 | Japan . | |
| 60-147563 | 8/1985 | Japan . | |

*Primary Examiner*—Carl Stuart Miller
*Attorney, Agent, or Firm*—Cushman, Darby & Cushman

[57] ABSTRACT

In a fuel pump driving apparatus for a vehicle engine including a fuel injection system, the selection of a plurality of energizing circuits each formed by the combination of two or all of three brushes of a fuel pump drive motor is effected in accordance with the load conditions of the engine, thereby changing the rotational speed of the motor and hence the fuel quantity delivered from the fuel pump. When the occurrence of a fault in one of the energizing circuits is detected, the driver is informed of the occurrence of the fault and in addition a faulty-condition controller controls switching means in such a manner that the drive motor is energized through another one of the energizing circuits.

5 Claims, 9 Drawing Sheets

FUEL PUMP DRIVING APPARATUS

BACKGROUND OF THE INVENTION

The present invention relates to a fuel pump driving apparatus which is used for example with an engine including a fuel injection system.

A conventional fuel pump driving apparatus of the above type is shown in Japanese Unexamined Publication No. 57-146044.

The apparatus of this publication is designed so that with a fuel pump driven by a motor having three brushes one of which is connected to a power source and the other two are grounded, a switching relay is connected between the grounded brushes and the ground such that either one of the grounded brushes is connected to the ground in accordance with the engine condition, thereby controlling the delivery rate of the pump.

By thus controlling the delivery rate in accordance with the engine condition, there is the effect of saving the power consumption of the motor and reducing the occurrence of noise.

With the apparatus of this construction, however, the effective utilization of the pump driven by the motor having the three brushes has not been satisfactory as yet and there has still been room for improvement.

SUMMARY OF THE INVENTION

It is a first object of the present invention to provide a fuel pump driving apparatus which improves upon the conventional driving apparatus of the type that drives a fuel pump by a motor having three brushes as disclosed in the above-mentioned publication, thereby ensuring an effective utilization of the pump driven by the motor having the three brushes.

To accomplish the first object, in accordance with a first aspect of the invention there is thus provided a fuel pump driving apparatus for engines which includes, as shown in FIGS. 1 and 9, a pump drive motor having first and second brushes arranged to oppose each other on both sides of an armature and a third brush arranged separately from the first and second brushes, and switching means responsive to the load condition of the engine to effect the selection of two armature energizing circuits each formed by selected two of the first to third brushes and another armature energizing circuit formed by all of the first to third brushes.

It is to be noted that in the above-described construction one of the first and second brushes is arranged on the power source side and the other brush is arranged on the ground side. Also, the third brush is arranged on either the power source side or the ground side depending on the design specification.

With this construction, the energization of the motor by any selected two of the first to third brushes and the energization of the motor by all of the first to third brushes are controlled by the switching means to control the amount of fuel delivered from the fuel pump. In this connection, particularly when the motor is energized by using all of the first to third brushes, the resulting fuel quantity delivered is intermediary between the fuel quantity delivered when the motor is energized by means of the first and second brushes and the fuel quantity delivered when the motor is energized by means of the third brush and the first or second brush.

By suitably changing the energizing circuits provided by the three-brush motor in accordance with the engine load conditions, it is possible to easily change the rotation speed of the motor from one to another and hence easily realize changing of the fuel quantity delivered from the fuel pump from one to another and also the switching control including the formation of the energizing circuit by all of the first to third brushes is effected thus making it possible to easily control the delivered fuel quantity of the fuel pump at a plurality of levels. Thus, there is a great effect of realizing the effective utilization peculiar to the fuel pump driven by the motor having the three brushes.

Also, with the construction disclosed in the previously mentioned publication, when a contact failure occurs in the switching relay, the current flow to the motor is interrupted so that there is the danger of making impossible the delivery of fuel from the fuel pump, whereas where the apparatus is used with a vehicle, there is the danger of making impossible the running of the vehicle.

Therefore, in view of the above-mentioned deficiency, it is a second object of the invention to provide a fuel pump driving apparatus so designed that when a fault occurs in the energization of a motor, the driver is informed of the fault to rapidly take the appropriate measure and also the current flow to the motor is maintained as far as possible to allow the vehicle to make an evacuation running.

To overcome the foregoing deficiency, in accordance with a second phase of the invention there is thus provided a fuel pump driving apparatus for an engine of a vehicle which includes, as shown in FIG. 14, a fuel pump for forcing out the fuel in a fuel tank to fuel injection valves for supplying the fuel to the vehicle engine; a drive motor having a first brush connected to the ground and second and third brushes connected to a power source to drive the fuel pump; first switch means connected between the second brush and the power source; second switch means connected in parallel with the first switch means between the third brush and the power source; first detecting means for detecting a terminal voltage applied to the second brush; second detecting means for detecting a terminal voltage applied to the third brush; first driving means for driving the first switch means; second driving means for driving the second switch means in opposition to the first switch means; discriminating means for determining not faulty when, with the first switch means being closed by the first driving means and the second switch means being opened by the second driving means, the terminal voltage of the second brush detected by the first detecting means is greater than a predetermined value and the terminal voltage of the third brush detected by the second detecting means is smaller than the predetermined value as well as when, with the first switch means being opened by the first detecting means and the second switch means being closed by the second driving means, the terminal voltage of the second brush detected by the first detecting means is smaller than the predetermined value and the terminal voltage of the third brush detected by the second detecting means is greater than the predetermined value and determining faulty in other circumstances; warning means responsive to the determination of a faulty condition by the discriminating means to inform the vehicle driver of the faulty condition; and faulty-condition control means responsive to the determination of the faulty condition by the discriminating means to control the first and second driving means in such a manner that a current is supplied to the drive motor through at least either one of the first and second switch means.

In accordance with this construction, when the discriminating means determines not faulty, a current is supplied to the drive motor through the first switch means or the second switch means so that the drive motor is rotated at a rotational speed corresponding to the positional relation between the second or third brush and the first brush and the fuel pump delivers the fuel in an amount corresponding to this rotational speed. On the contrary, when the discriminating means determines faulty, the warning means informs the driver of the fault in the energizing system and at the same time the faulty-condition control means controls the first and second driving means in such a manner that the flow of current to the drive motor is maintained through either one of the first and second switch means, thereby ensuring the minimum operation of the fuel pump.

Thus, the fuel pump driving apparatus according to the second phase of the invention has a great effect that when the discriminating means detects the occurrence of a fault in the drive motor energizing circuits including the first and second switch means, the warning means informs the driver of the occurrence of the fault while controlling the first and second driving means by the faulty-condition control means in such a manner that a current is supplied to the drive motor through either one of the first and second switch means and moreover it is quite unusual for the first and second switch means to simultaneously fail to energize the motor, thus maintaining the current flow to the drive motor through at least either one of the first and second switch means and thereby ensuring at least the minimum operation of the fuel pump to allow the vehicle to make an evacuation running.

DESCRIPTION OF THE PREFERRED EMBODIMENTS

An embodiment of the present invention will now be described with reference to the drawings.

Figure 2:
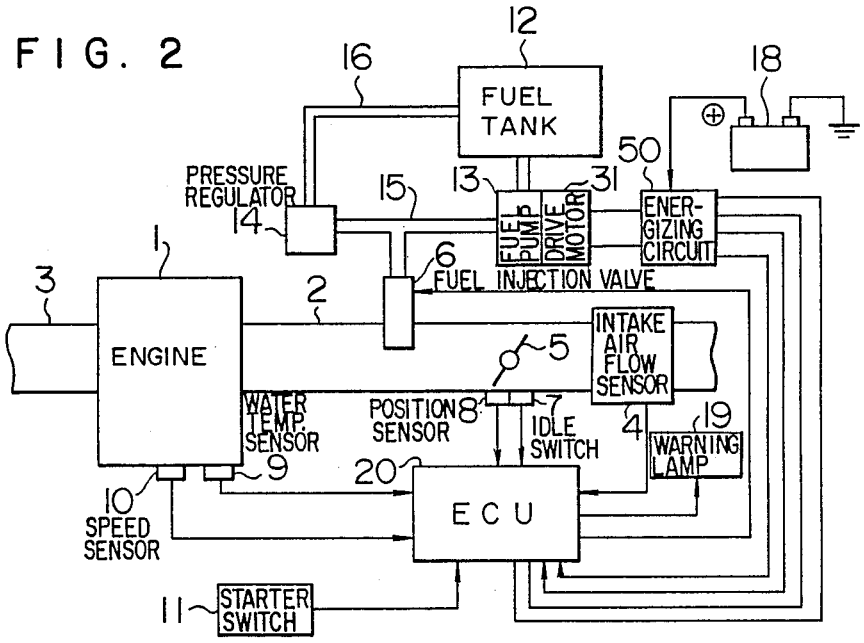
FIG. 2 is a block diagram schematically showing the construction of an engine to which the first embodiment of the invention is applied and its peripheral units.

Referring first to FIG. 2, there is illustrated a block diagram showing schematically the construction of an engine and its peripheral units. In the Figure, numeral 1 designates a four-cycle engine for automobiles and connected to the engine 1 are an intake pipe 2 and an exhaust pipe 3.

An air cleaner (not shown), an intake air flow sensor 4, a throttle valve 5 and an electromagnetic fuel injection valve 6 are arranged in this order from the upstream side within the intake pipe 2.

In addition, there are provided an idle switch 7 for detecting that the throttle valve 5 is substantially fully closed and a position sensor 8 for detecting the position of the throttle valve 5. The engine 1 is also provided with a water temperature sensor 9 for detecting the temperature of cooling water for cooling the engine 1 and a speed sensor 10 for detecting the speed of the engine 1.

Numeral 11 designates a starter switch for detecting the operating condition of the starter which is not shown and the starter switch 11 generates a high-level signal when the starter is in operation.

Numeral 12 designates a fuel tank, 13 a fuel pump, and 14 a pressure regulator. The fuel in the fuel tank 12 is supplied to the fuel injection valve 6 by the fuel pump 13 through a pipe line 15. The fuel pressure in the pipe line 15 is adjusted for example in accordance with the pressure downstream of the throttle valve 5 by the pressure regulator 14 arranged at one end of the pipe line 15. Then, the fuel passed through the pressure regulator 14 is returned to the fuel tank 12 through a pipe line 16.

The fuel pump 13 is driven by a drive motor 31 and the drive motor 31 is energized from a battery 18 through an energizing circuit 50.

Numeral 19 designates a warning lamp which is turned on when it is determined that the energizing circuit 50 for the drive motor 13 is in a faulty condition.

Numeral 20 designates an engine control unit (ECU) including a microcomputer as its principal part, and the ECU 20 receive the intake air flow signal from the intake air flow sensor 4, the fully-closed position signal from the idle switch 7, the position signal from the position sensor 8, the water temperature signal from the water temperature sensor 9, the speed signal from the speed sensor 10, the signal from the starter switch 11 and the two signals from the energizing circuit 50 to control the fuel injection valves 6 and the fuel pump 13 in accordance with these input signals.

Figure 1:
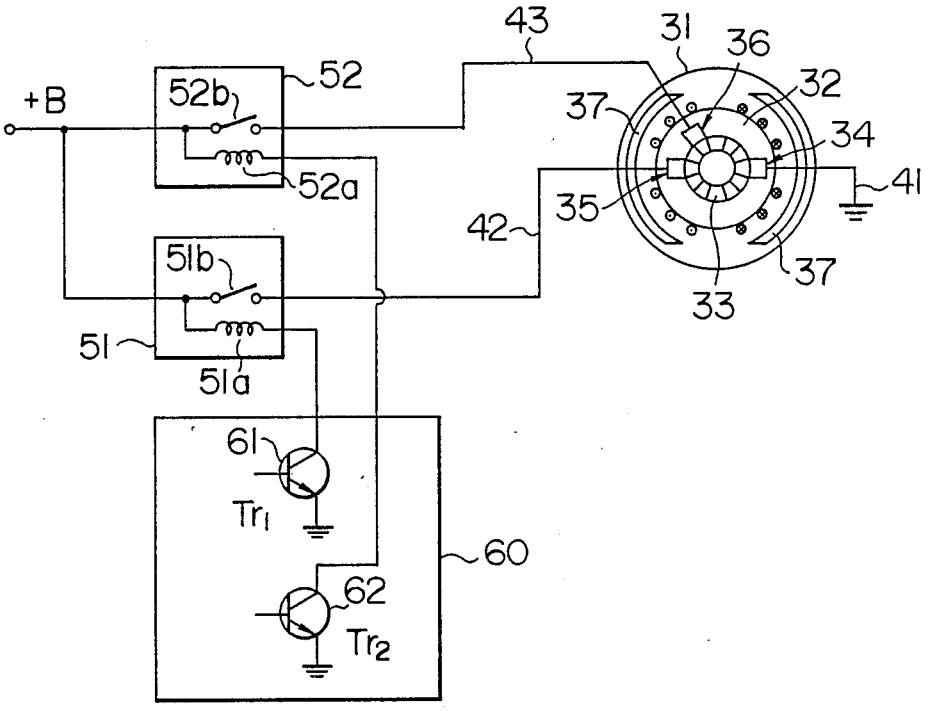
FIG. 1 is a circuit diagram showing the construction of a first embodiment of the present invention.

Referring to FIG. 1, there is illustrated a circuit diagram showing the schematic construction of the drive motor 31 for the fuel pump 13 and the energizing circuit for the drive motor 31.

In the drive motor 31, numeral 32 designates an armature, 33 a commutator which is made integral with one end of the armature 32, 34 a first brush contacted with the commutator 33 and grounded through a line 41, 35 a second brush arranged opposite to the first brush 34 through the armature 32, contacted with the commutator 33 and connected to a power supply +B through a line 42, 36 a third brush contacted with the commutator 33 and connected to the power supply +B through a line 43, and 37 a pair of magnets each fixedly arranged along the outer periphery of the armature 32 through an air gap. Note that the third brush 36 is arranged closer to the first brush 34 than the second brush 35 in the circumferential direction along the commutator 33.

In addition, a first relay 51 including an excitation coil 51*a* and a switch 51*b* is arranged on the line 42 interconnecting the power supply +B and the second brush 35, and a second relay 52 including an excitation coil 52*a* and a switch 52*b* is arranged on the line 43 interconnecting the power supply +B and the third brush 36.

Also, the excitation coil 51*a* of the first relay 51 and the excitation coil 52*a* of the second relay 52 are respectively connected to the collectors of first and second transistors 61 and 62 included in a drive circuit 60 of the ECU 20 for the drive motor 31 of the fuel pump 13, and in accordance with the input signals to the ECU 20 a "1" level signal is applied to the base of each of the transistors 61 and 62, thereby controlling the on-off operations of the first and second transistors 61 and 62.

Then, the drive motor 31 having the brushes 34, 35 and 36 has a characteristic such that its rotational speed is increased when an energizing circuit is formed by means of the first and third brushes 34 and 36 as compared when an energizing circuit is formed by means of the first and second brushes 34 and 35. Also, when an energizing circuit is formed by use of all of the first, second and third brushes 34, 35 and 36 with the current flowing simultaneously from both the second and third brushes 35 and 36, the resulting rotational speed becomes substantially intermediary between the rotational speed obtained when the energizing circuit is formed by the first and second brushes 34 and 35 and the rotational speed obtained when the energizing circuit is formed by the first and third brushes 34 and 36. This fact will now be described in greater detail.

Figure 3:
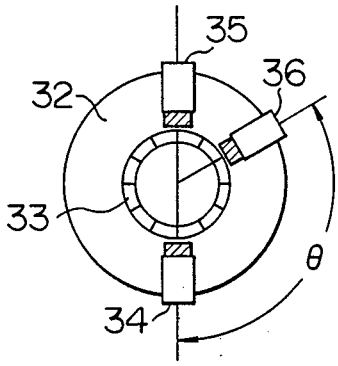
FIGS. 3 to 6 are diagrams useful for explaining the principle of controlling the delivery rate characteristic of the fuel pump, with FIG. 3 showing the brush angle $\theta$ with respect to the armature, FIG. 4 showing a $\theta$-flux density characteristic diagram, FIG. 5 showing a $\theta$-motor rotational speed N characteristic diagram and FIGS. 6A to 6C showing various positional relations of the energizing brushes.
Figure 4:
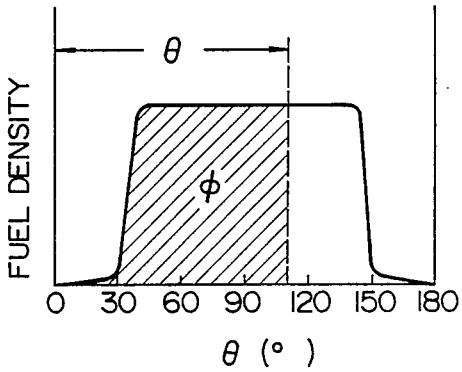
Figure 5:
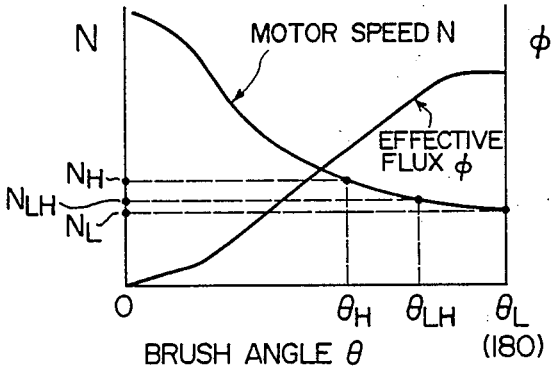
Figure 6A:
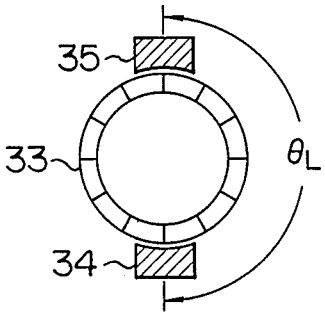
Figure 6B:
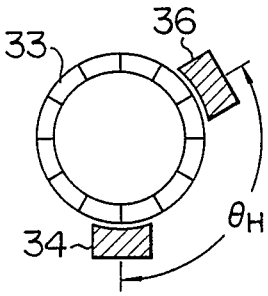
Figure 6C:
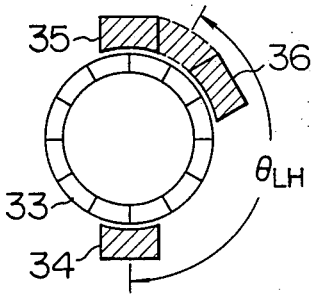

The rotational speed N of the motor 31 is substantially proportional to the applied voltage $V_B$ to the motor 31 and is inversely proportional to the e magnetic flux $\phi$. The flux density in the armature 32 varies with the angle $\theta$ (See FIG. 3) between the power source-side brushes (the second and third brushes 35 and 36) and the ground-side brush (the first brush 34) as shown in FIG. 4. Therefore, the effective magnetic flux $\phi$ increases with an increase in the brush angle $\theta$ and thus the rotational speed N of the motor 31 varies with the brush angle $\theta$ as shown in FIG. 5. In other words, where the motor 31 is energized by means of the first and second brushes 34 and 35 as shown in FIG. 6A, a low rotational speed $N_L$ corresponding to the resulting brush angle $\theta_L$ is obtained as shown in FIG. 5, whereas when the motor 31 is energized by the first and third brushes 34 and 36 as shown in FIG. 6B, a high rotational speed $N_H$ corresponding to the resulting brush angle $\theta_H$ is obtained. Then, where the motor 31 is energized by using all the brushes 34, 35 and 36, a condition substantially equivalent to one obtained by providing a brush at an intermediary position between the second and third brushes 35 and 36 as shown in FIG. 6C is obtained and an intermediate rotational speed $N_{LH}$ corresponding to the resulting brush angle $\theta_{LH}$ is obtained as shown in FIG. 5.

Figure 7:
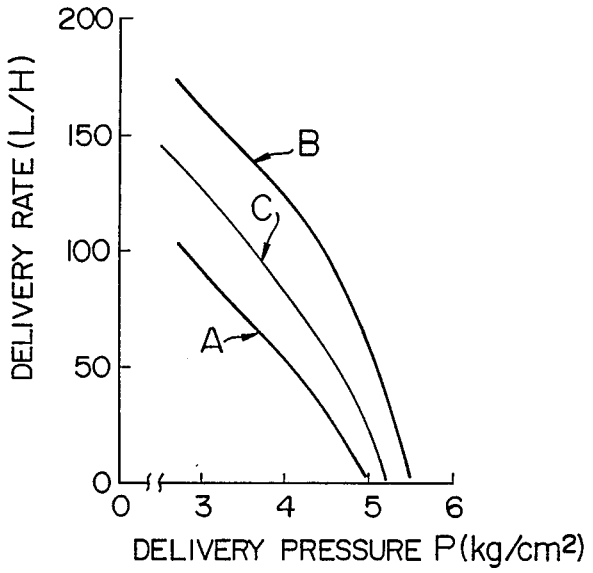
FIG. 7 is a delivery rate characteristic diagram of the fuel pump used in the first embodiment.

Referring to FIG. 7 showing the experimental results on the delivery rate characteristic of the fuel pump 13 driven by the motor 31, the characteristic A of FIG. 7 is obtained when an energizing circuit is provided by the first and second brushes 34 and 35, the characteristic B of FIG. 7 is obtained when an energizing circuit is provided by the first and third brushes 34 and 36, and the characteristic C of FIG. 7 or one which is substantially intermediary between the characteristics A and B is obtained when an energizing circuit is provided by all of the first, second and third brushes 34, 35 and 36. It is to be noted that in this experiment the armature 32 was of the lap winding type having a number of turns of 14, a slot number of 12 and a diameter of 35 mm and the magnets had an inner diameter of 36.1 mm and an outer diameter of 47.3 mm with the externally provided housing being 50.7 mm in outer diameter. The angle between the second and third brushes 35 and 36 was 70° and the applied voltage was 12 V. Also, a regenerative pump including a closed vane-type impeller formed with a large number of vane slots on the outer periphery side of each surface was used.

With the construction described above, the operation of the embodiment will now be described with reference to the control flow chart of the ECU 20 shown in FIG. 8.

When the ignition switch (not shown) is turned on first, the power supply voltage +B is applied to the relays 51 and 52 and the ECU 20. Then, the ECU 20 is started at a step 100 of FIG. 8 and its various internal functions are then initialized at a step 101. At the step 101, the first and second transistors ($Tr_1$) 61 and ($Tr_2$) 62 are first turned off and thus the relays 51 and 52 are turned off.

Then, a transfer is made to a step 102 so that in accordance with the signal from the starter switch 11 a decision is made as to whether the starter has been turned on. If the decision is yes, a branch or jump is made to a step 106 which will be described later. If the starter has been turned off, a transfer is made to the next step 103. At the step 103, whether the engine speed Ne is zero rpm, that is whether the engine 1 is at rest is determined in accordance with the speed signal from the speed sensor 10. If it is determined that Ne=0 rpm, the following processing is entirely omitted so that a jump is made to a step 110 and a return is again made to the step 102. If it is determined that Ne≠0 rpm, a transfer is made to the next step 104 so that in accordance with the load condition Q/Ne determined on the basis of the intake air flow signal from the intake air flow sensor 4 and the speed signal from the speed sensor 10, a decision is made as to whether the current load condition Q/Ne is a high load. If it is, a jump is made to the step 106 which will be described later. If it is not, a transfer is made to the next step 105 where it is determined whether the load condition Q/Ne is a low-load condition. If it is, a jump is made to a step 108. If it is not, that is, in the case of an intermediate load, a transfer is made to a step 107. In this way, the current load condition Q/Ne is subjected to the three-level appraisal at the steps 104 and 105 so that in accordance with the load condition Q/Ne a jump is made to the step 106, 107 or 108 to perform the necessary operation in the following manner.

Starting and high-load conditions: Step 106 . . . $Tr_1$=off, $Tr_2$=on

Intermediate-load condition: Step 107 . . . $Tr_1$=on, $Tr_2$=on

Low-load condition:Step 108 . . . $Tr_1$=on, $Tr_2$=off

In accordance with these steps, the $Tr_1$ 61 and $Tr_2$ 62 are turned on and off and the relays 51 and 52 are turned on and off correspondingly.

In other words, during the starting period and the high-load operation, a current flows to the excitation coil 52*a* of the relay 52 so that the switch 52*b* is closed and the third brush 36 is connected to the power supply +B through the relay 52, thereby forming an energizing circuit comprising the first and third brushes 34 and 36 for the armature 32. Thus, the drive motor 31 is rotated at a high speed and the fuel pump 13 delivers a large quantity of fuel.

Also, during the low-load operation, a current flows to the excitation coil 51*a* of the relay 51 so that the switch 51*b* is closed and the second brush 35 is connected to the power supply +B through the relay 51, thereby forming an energizing circuit comprising the first and second brushes 34, 35 for the armature 32. Thus, the drive motor 31 is operated at a low speed and the fuel quantity delivered from the fuel pump 13 is controlled at a low level.

Also, during the intermediate-load operation, both of the switches 51*b* and 52*b* of the relays 51 and 52 are closed and thus an energizing circuit comprising all of the first, second and third brushes 34, 35 and 36 is formed. As a result, the drive motor 31 is rotated at a speed which is intermediary between the cases where the energizing circuit is formed by the first and second brushes 34 and 35 and where the energizing circuit is formed by the first and third brushes 34 and 36, so that the fuel pump 13 delivers the fuel in an amount substantially intermediary between the fuel quantity delivers during the starting period and the high-load operation and the fuel quantity delivered during the low-load operation.

After the steps 106 to 108 have been performed, a transfer is made to a step 109 where the processes for the known control on the valve opening duration of the fuel injection valves 6, the known ignition timing control in the ignition system (not shown), etc., are performed, and the whole processing is ended at the next step 110, thereby again making a return to the step 102.

In accordance with the above-described embodiment the three energizing circuits for the motor 31 having the three brushes 34, 35 and 36 are selectively used through the two relays 51 and 52 and thus the fuel quantity delivery characteristic of the fuel pump 13 is easily changeable to any of the three levels, thereby making it possible to very effectively utilize the fuel pump 13 driven by the motor 31 having the three brushes 34, 35 and 36.

While, in the above-described embodiment, the load is determined in terms of Q/Ne, it is possible to effect the determination of the low, intermediate and high loads in correspondence to the openings of the throttle valve 5. For example, the load is determined low when the idle switch 7 is turned on, that is, when the throttle valve 5 is substantially closed fully, and the load is determined intermediate when the idle switch 7 is turned off and the throttle valve 5 is determine smaller than a given opening in accordance with the position signal from the position sensor 8. Also, the load is determined high when the throttle valve 5 is determined greater than the given opening in accordance with the position signal from the position sensor 8.

On the other hand, where the warning-up condition of the engine 1 is taken into consideration, the reference level for determining the low, intermediate and high loads may be varied in accordance with the water temperature signal from the water temperature sensor 9.

Figure 9:
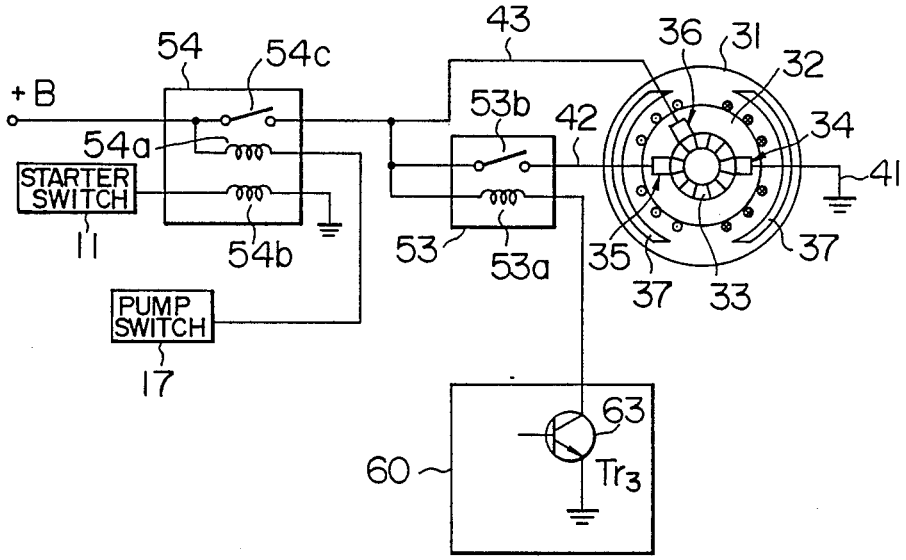
FIG. 9 is a circuit diagram showing the construction of a second embodiment of the invention.
Figure 10:
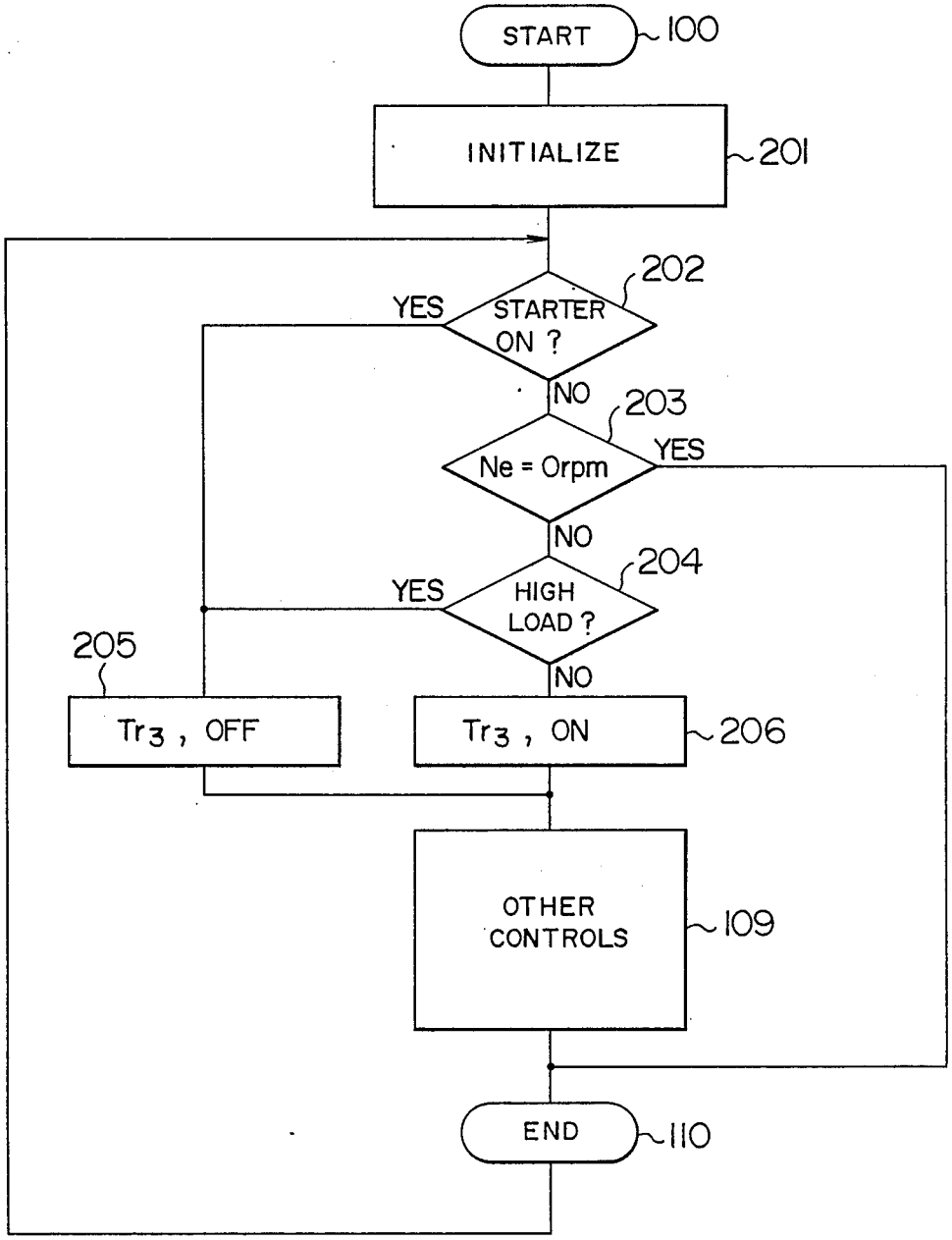
FIG. 10 is a control flow chart for the second embodiment of FIG. 9.

A second embodiment of the invention will now be described with reference to FIGS. 9 and 10. Note that components identical in construction with their counterparts of the first embodiment are designated by the same reference numerals and will not be explained.

Arranged on the line 42 is a pump relay 53 including an excitation coil 53*a* connected to the collector of a transistor ($Tr_3$) 63 of the drive circuit 60 in the ECU 20 and a switch 53*b*, and also a circuit relay 54 is connected between the junction point of the lines 42 and 43 and the power supply +B. The circuit relay 54 includes an excitation coil 54*a* connected to a pump switch 17 incorporated in the intake air flow sensor 4, an excitation coil 54*b* connected to the starter switch 11 and a switch 54*c*. Note that the pump switch 17 is turned on when the intake air flow sensor 4 detects that the engine 1 is drawing air.

As a result, the circuit relay 54 is always turned on during the time that the engine 1 is in operation thereby connecting the power supply +B to the third brush 36, and the pump relay 53 opens and closes its switch 53*b* in response to the turning on and off of the $Tr_3$ 63 of the drive circuit 60 thereby connecting the second brush 35 to the power supply +B in response to the closing of the switch 53*b*.

In other words, in this embodiment the pump relay 53 is turned on and off to effect the switching between the energizing circuit formed by the first and third brushes 34 and 36 for the armature 32 and the energizing circuit formed by all of the first, second and third brushes 34, 35 and 36 for the armature 32.

With the construction described above, the operation of the second embodiment will now be described with reference to the control flow chart of the ECU 20 shown in FIG. 10.

When the ignition switch (not shown) is turned on first, the supply voltage +B is applied to the circuit relay 54 and the ECU 20. Thus, the ECU 20 is started at a step 100 of FIG. 10 and then its various internal functions are initialized at the next step 201. Then, a transfer is made to a step 202 to determine whether the starter has been turned on in accordance with the signal from the starter switch 11. If it is determined that the starter has been turned on, a transfer is made to a step 205 which will be described later. If the starter has been turned off, a transfer is made to the next step 203 so that whether the engine speed Ne is zero rpm or whether the engine 1 is at rest is determined in accordance with the speed signal from the speed sensor 10. If it is determined that Ne=0 rpm, the following whole processing is omitted so that a jump is first made to a step 110 and a return is made again to the step 202. If it is determined that Ne≠0 rpm, a transfer is made to the next step 204 so that in accordance with the load condition Q/Ne determined on the basis of the signals from the intake air flow sensor 4 and the speed sensor 10, it is determined whether the current load condition Q/Ne is a high load. If the load is determined high, a transfer is made to the step 206. On the contrary, if the load is not high (=the intermediate or low load), a transfer is made to a step 206. In this way, the current operating condition is determined at the step 202 to 204 and in accordance with the operating condition a jump is made to the step 205 or 206, thereby processing in the following manner.

Starting and high-load conditions: Step 205 . . .
$Tr_3$=off

Intermediate- and low-load conditions: Step 206 . . .
$Tr_3$=on

In this case, the supply voltage +B is always applied to the third brush 36 of the drive motor 31 during the engine operation with the result that by virtue of the above-mentioned processing, the fuel pump 3 delivers a large quantity of the fuel according to the flow characteristic shown by the characteristic B of FIG. during the starting period and the high-load operation, whereas during the intermediate-load and low-load operations the fuel is delivered according to the flow characteristic shown by the characteristic C of FIG. 7 thereby delivering the fuel quantity restrained as compared with the fuel quantity delivered during the starting period and the high-load operation.

Figure 8:
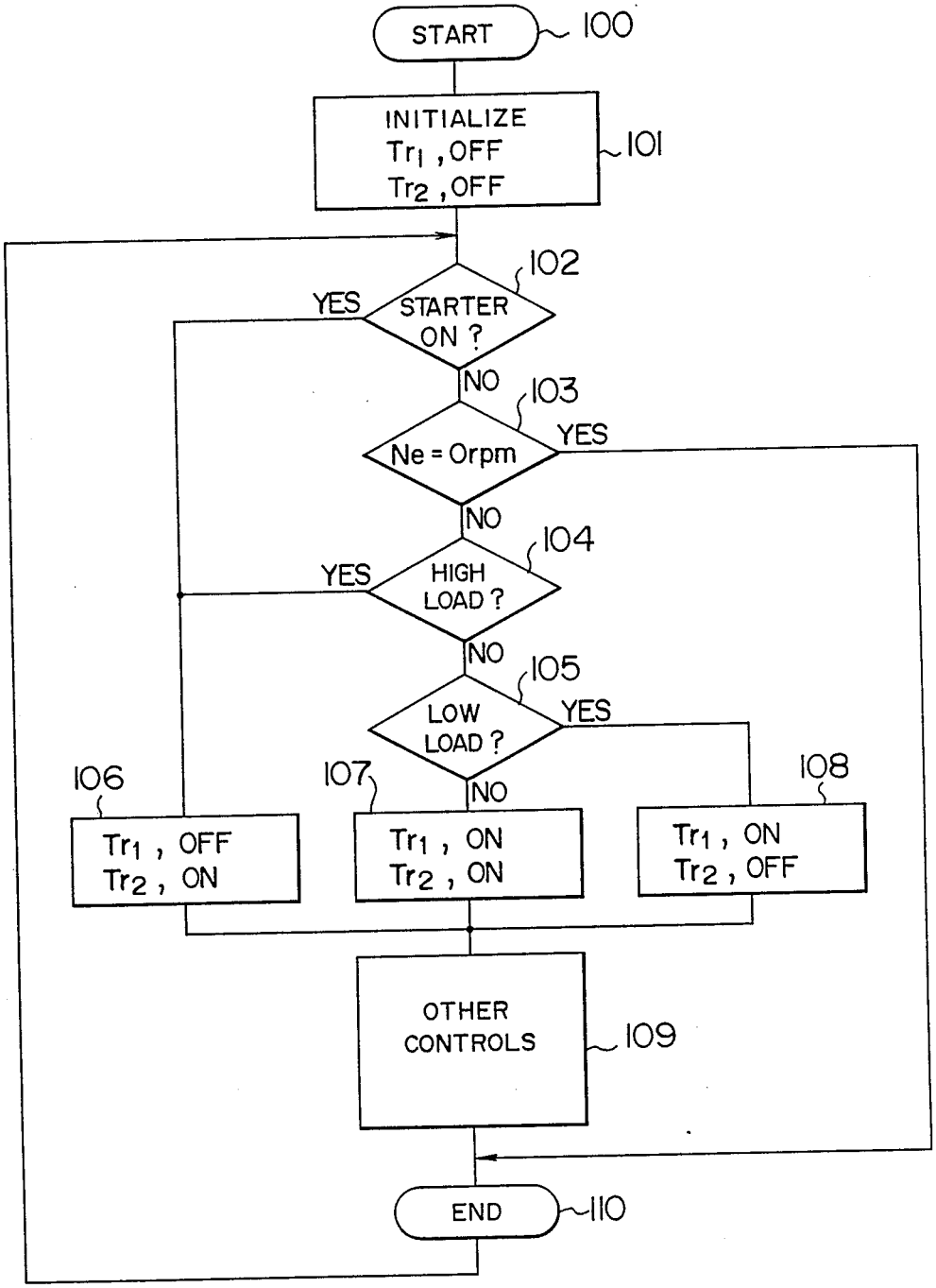
FIG. 8 is a control flow chart for the first embodiment.

After the steps 205 and 206 have been performed, the processing proceeds through steps 109 and 110 thereby performing the similar operations as the steps 109 and 110 shown in FIG. 8.

In accordance with this embodiment, the switching between the two energizing circuits for the motor 31 having the three brushes 34, 35 and 36 can be easily effected by use of the single pump relay 53 and the fuel delivery rate of the fuel pump 13 driven by the motor 31 having the brushes 34, 35 and 36 can be easily controlled with the simple construction.

Further, in this embodiment the connection of the third brush 36 and the power supply +B is ensured even if a fault or a break in the wiring is caused in the pump relay 53, thereby ensuring the fuel supply to the fuel injection valves 6 and increasing the reliability.

Figure 11:
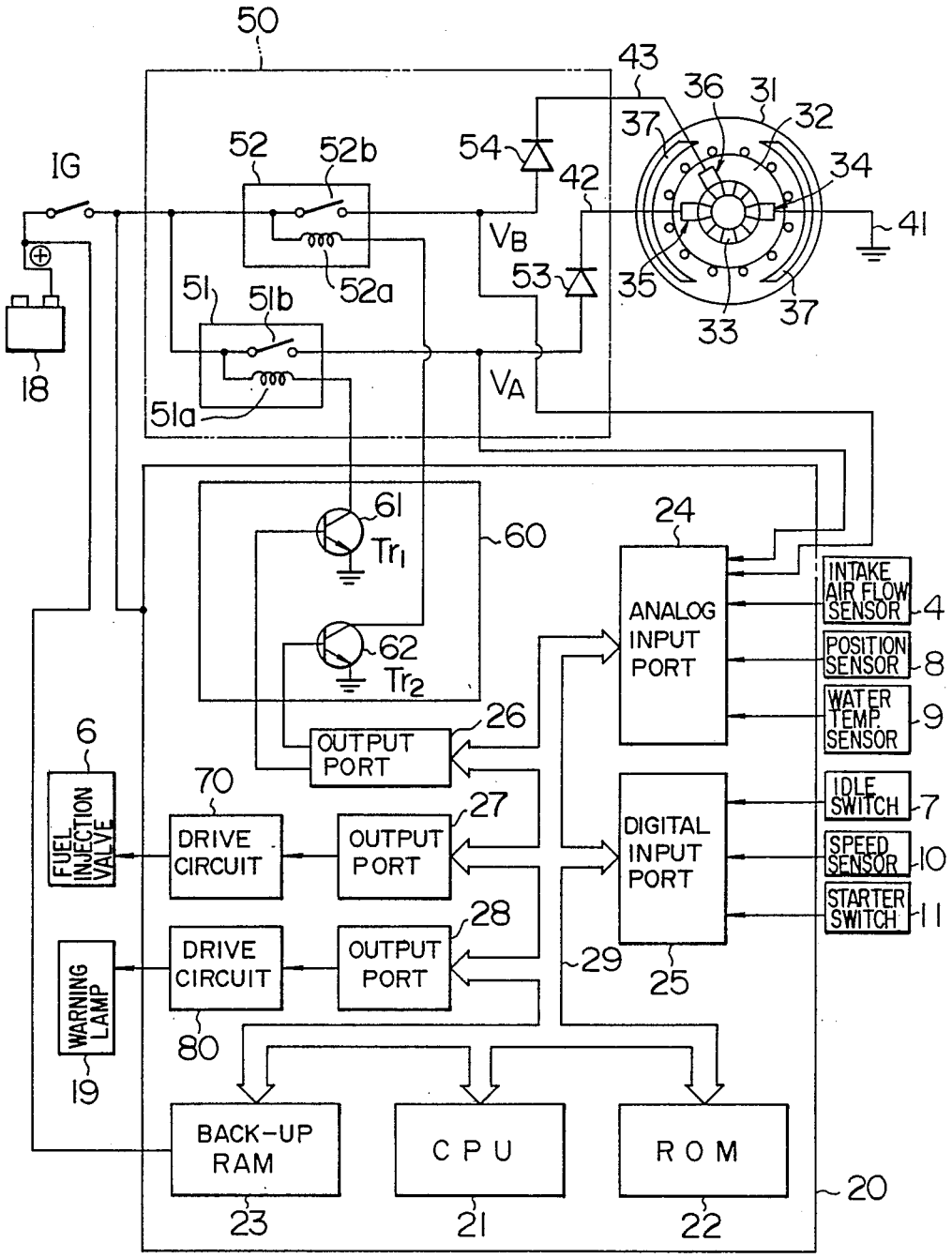
FIG. 11 is a schematic block diagram showing the constructions of a third embodiment of the invention, an engine to which the third embodiment is applied and its peripheral units.

Referring to FIG. 11 showing a third embodiment of the invention, there is illustrated a block diagram showing the schematic construction of a drive motor 31 for a fuel pump 13, the construction of an energizing circuit 50 for the drive motor 31 and the construction of an ECU 20.

With the drive motor 31, numeral 32 designates an armature, 33 a commutator which is made integral with one end of the armature 32, 34 a first brush contacted with the commutator 33 and grounded through a line 41, 35 a second brush arranged opposite to the first brush 34 through the armature 32, contacted with the commutator 33 and connected to a battery 18 through a line 42, 36 a third brush contacted with the commutator 33 and connected to the battery 18 through a line 43, and 37 a pair of magnets each fastened along the outer periphery of the armature 32 through an air gap. Note that the third brush 36 is arranged closer to the first brush 34 than the second brush 35 in the circumferential direction along the commutator 33.

In the energizing circuit 50, a first relay 51 including an excitation coil 51*a* and a switch 51*b* and and forming first switch means is arranged on the line 42 connecting the battery 18 and the second brush 35 and a diode 53 is connected between the first relay 51 and the second brush 35. Also, a second relay 52 including an excitation coil 52*a* and a switch 52*b* and forming second switch means is arranged on the line 43 connecting the battery 18 and the third brush 36 and a diode 54 is connected between the second relay 52 and the third brush 36.

Also, an ignition switch IG is connected between the power source 18 and the energizing circuit 50.

The ECU 20 includes a CPU 21 for performing various computations, an ROM 22 preliminarily storing constants used in the computations of the CPU 21, etc., a back-up RAM 23 for temporarily storing data, e.g., the computation results of the CPU 21, an analog input port 24 with A/D conversion function for receiving analog signals such as intake air flow signal, throttle position signal, water temperature signal and voltage signals $V_A$ and $V_B$, a digital input port 25 for receiving input signals such as fully-closed position signal, speed signal and the signal from the starter switch 11, output ports 26, 27 and 28 for generating signals in response to the computation results of the CPU 21, a drive circuit 60 responsive to the signals from the output port 26 to generate drive signals for the first and second relays 51 and 52 of the energizing circuit 60, a drive circuit 70 responsive to the signal from the output port 27 to generate a drive signal for each fuel injection valve 6, a drive circuit 80 responsive to the signal from the output port 28 to turn a warning lamp 19 on, and a data bus 29 interconnecting the CPU 21, the ROM 22, the back-up RAM 23, the analog input port 24, the digital input port 25 and the output ports 26, 27 and 28. The ECU 20 is connected to the battery 18 through the ignition switch IG. Note that the back-up RAM 23 is directly connected to the battery 18 so that its stored data are maintained even after the opening of the ignition switch IG. The voltage signals $V_A$ and $V_B$ applied to the analog input port 24 from the energizing circuit 50 are respectively the terminal voltages applied to the second and third brushes 35 and 36 and the voltage signals $V_A$ and $V_B$ are respectively taken from between the first relay 51 and the second brush 35 and between the second relay 52 and the third brush 36.

The drive circuit 60 includes a first transistor (hereinafter also referred to as a $Tr_1$) 61 and a second transistor (hereinafter also referred to as a $Tr_2$) 62 which are each turned on and off in opposition to its partner by the signal from the output port 26. The collector of the first transistor 61 is connected to the excitation coil 51*a* of the first relay 51 and the collector of the second transistor 62 is connected to the excitation coil 52*a* of the second relay 52. In other words, the first transistor 61 forms first drive means and the second transistor 62 forms second drive means.

On the other hand, the drive motor 31 with the brushes 34, 35 and 36 has a characteristic such that when its energization is effected by use of the first and third brushes 34 and 36, the resulting rotational speed is higher than the rotational speed obtained when the energization is effected by use of the first and second brushes 34 and 35.

Figure 12:
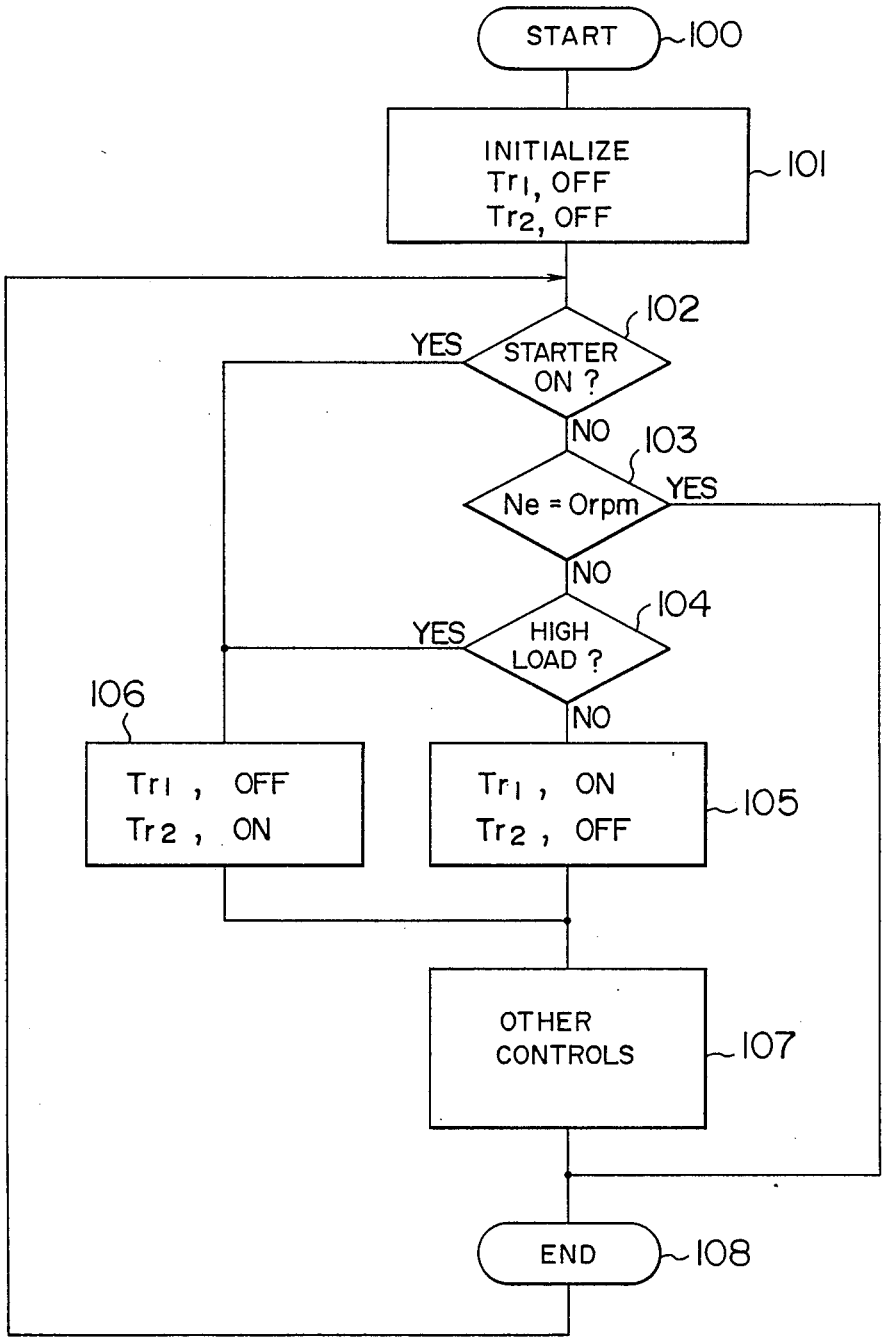
FIGS. 12 and 13 are flow charts showing the program executed by the CPU of FIG. 11.

With the construction described above, the operation of the apparatus will now be described with reference to FIG. 12. FIG. 12 shows a flow chart of the program executed by the CPU 21.

When the ignition switch IG is turned on first, the voltage of the battery 18 is applied to the first and second relays 51 and 52 and the ECU 20. Thus, the CPU 21 is started at a step 100 of FIG. 12 and then its various internal functions are initialized at a step 101. At the step 101, the first and second transistors 61 and 62 are turned off and thus the first and second relays 51 and 52 are turned off. Then, a transfer is made to a step 102 to determine whether the starter has been turned on in accordance with the signal from the starter switch 11. If the starter has been turned on, a jump is made to a step 106 which will be described later. If the starter has been turned off, a transfer is made to a step 103. At the step 103, it is determined whether the engine speed Ne is zero rpm or the engine 1 is at rest in accordance with the speed signal from the speed sensor 10. If it is determined that Ne=0 rpm, all of the following steps are eliminated so that a jump is made to a step 108 and a return is again made to the step 102. If it is determined that Ne≠0 rpm, a transfer is made to the next 104 so that in accordance with the load condition Q/Ne determined on the basis of the intake air flow signal from the intake air flow sensor 4 and the speed signal from the speed sensor 10, a decision is made as to whether the current load condition Q/Ne is a high load. If the load is determined high, a jump is made to the step 106 which will be described later. If it is determined to the contrary, a transfer is made to the next step 105. In this way, the current load condition Q/Ne is subjected to the two-level appraisal at the step 104 so that in accordance with the load condition Q/Ne, a jump is made to the step 105 or 106, thereby processing in the following manner.

Low-and intermediate-load conditions: Step 105 . . .
$Tr_1$=on, $Tr_2$=off

Starting and high-load conditions: Step 106 . . .
$Tr_1$=off, $Tr_2$=on

In accordance with these operations, the $Tr_1$ 61 and the $Tr_2$ 62 are turned on and off and the relays 51 and 52 are turned on and off correspondingly.

In other words, during the starting period and the high-load operation a current flows to the excitation coil 52*a* of the second coil 52 so that the switch 52*b* is closed and the third brush 36 is connected to the battery 18 through the second relay 52, thereby effecting energization of the armature 32 by means of the first and third brushes 34 and 36. Thus, the drive motor 31 is rotated at a high speed and the fuel pump 13 delivers a large quantity of the fuel.

During the low-load and intermediate-load operations, a current flows to the excitation 51*a* of the first relay 51 so that the switch 51*b* is closed and the second brush 35 is connected to the battery 18, thereby effecting energization of the armature 32 by means of the first and second brushes 34 and 35. Thus, the drive motor 31 is rotated at a low speed and the fuel quantity delivered from the fuel pump 13 is reduced to a low level.

After the step 105 or 106 has been performed, a transfer is made to a step 107 where such processes as the known control on the opening duration of the fuel injection valves 6 and the known ignition timing control in the ignition system (not shown) are performed and the whole processing is ended at the next step 108, thereby making again a return to the step 102.

Figure 13:
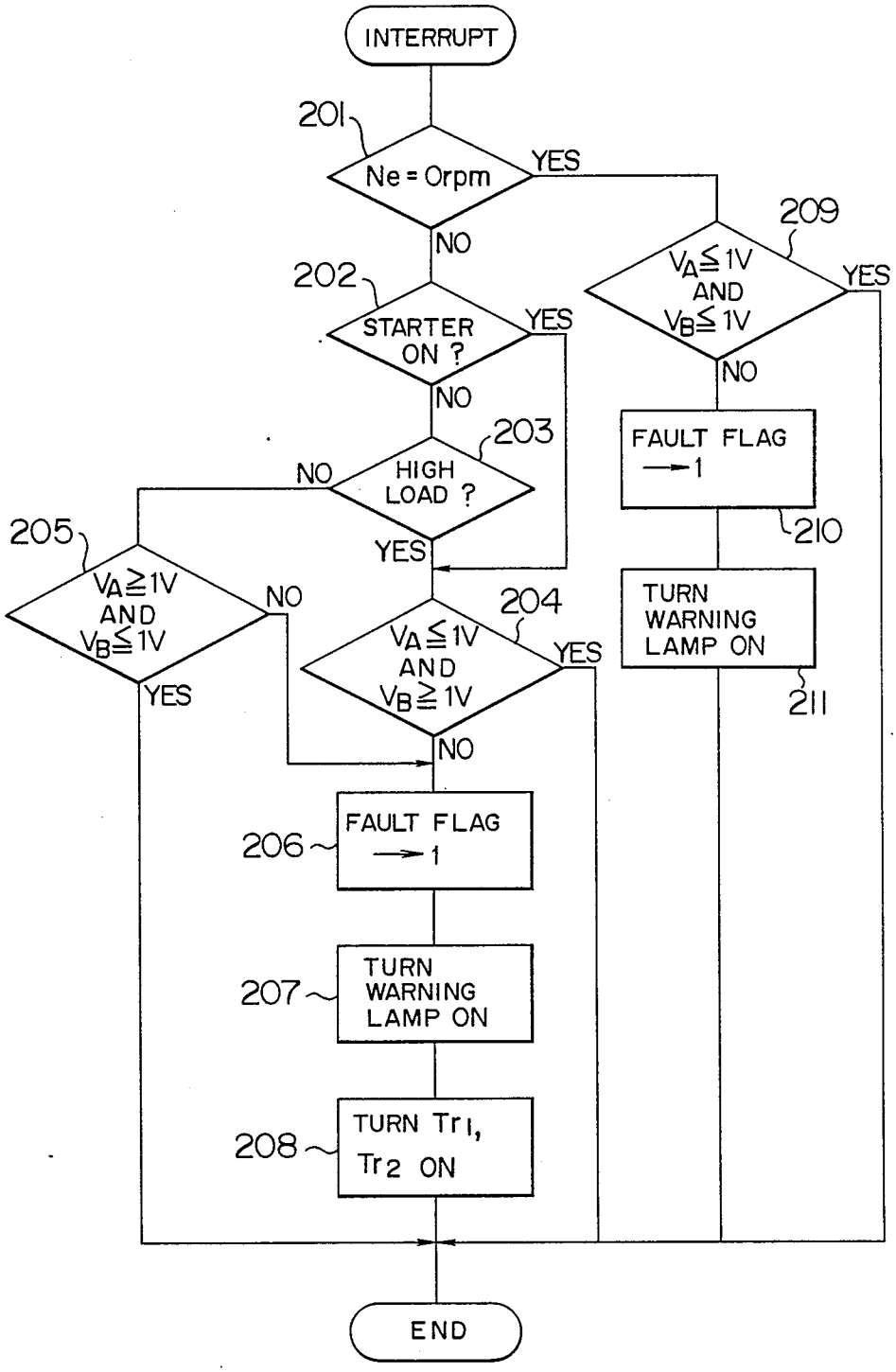
Figure 14:
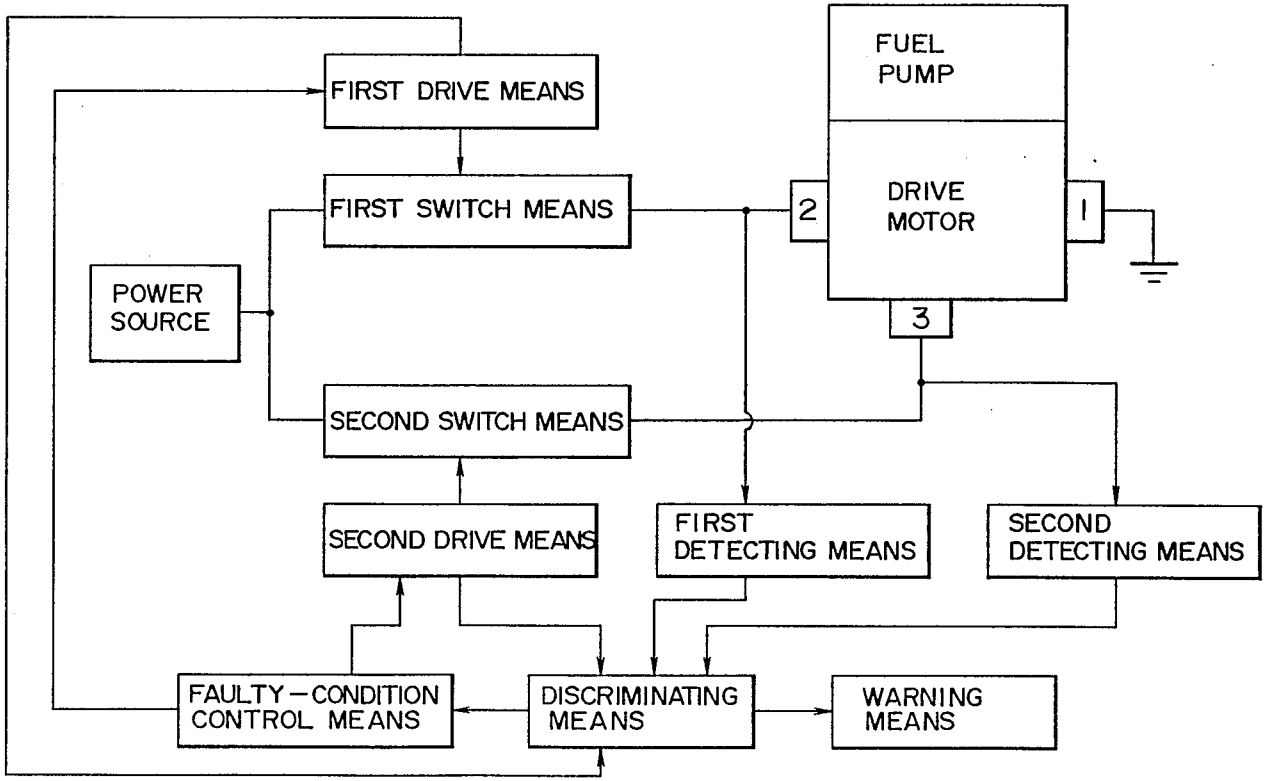
FIG. 14 is a block diagram schematically showing the construction of the invention.

The determination of whether the energizing circuit 50 including the first and second relays 51 and 52 has no faul or faulty and the necessary operations in case of a faulty condition will now be described with reference to FIG. 13. FIG. 13 shows a flow chart of the program executed by interruption actions of the CPU 21 at intervals of 64 ms, for example.

Firstly, at a step 201, it is determined whether the engine speed Ne is zero rpm, that is, whether the engine 1 is at rest. If it is determined that Ne=0 rpm, a transfer is made to a step 209. If it is determined that Ne≠0 rpm, a transfer is made to a step 202. At the step 202, it is determined whether the starter has been turned on. If the starter has been turned on, a transfer is made to a step 204 skipping or bypassing a step 203 which will be described later. If the starter has been turned off, a transfer is made to the step 203. At the step 203, it is determined whether the current load has been determined high in accordance with the load condition Q/Ne and the drive motor 31 has been rotated at the high speed. If the highload condition has been determined, that is, the second relay 52 has been closed thus rotating the drive motor 31 at the high speed, a transfer is made to the step 204. If the load condition has been determined not high, that is, the first relay 51 has been closed thus rotating the drive motor 31 at the low speed, a transfer is made to a step 205.

The steps 204 and 205 are decision steps which determine whether the first and second relays 51 and 52 of the energizing circuit 50 are functioning properly thus properly effecting the energization of the drive motor 31 in accordance with the program shown in FIG. 12. Thus, if the starting condition or the high-load condition has been determined thus making a transfer to the step 204, it is determined whether the voltage signals $V_A$ and $V_B$ are $V_A \leqq 1$ V and $V_B \geqq 1$ V. If this condition is satisfied, it is determined that there is no fault and the following steps are bypassed, thereby ending the processing. If this condition is not satisfied, it is determined that there is a fault in the energizing of the drive motor 31 by the energizing circuit 50 including the first and second relays 51 and 52.

On the other hand, if the low-load or intermediate-load condition has been determined thus making a transfer to the step 205, it is determined whether the voltage signals $V_A$ and $V_B$ are $V_A \geqq 1$ V and $V_B \geqq 1$ V. If this condition is satisfied, it is determined that there is no fault so that the following steps are bypassed and the processing is ended. If this condition is not satisfied, it is determined that there is a fault as mentioned previously.

Then, if the condition of the step 204 or 205 is not satisfied so that the occurrence of a fault is determined, a fault flag indicative of a fault in the drive system of the fuel pump 13 is set to "1" in the backup RAM 23 at a step 206. Then, at a step 207, a command is applied to the output port 28 so that the warning lamp 19 is turned on through the drive circuit 80 to inform the driver that the fault has occurred.

Also, at the step 208, the $Tr_1$ 61 and the $Tr_2$ 62 of the drive circuit 60 are simultaneously turned on from the output port 26. In other words, it is so arranged that the first and second relays 51 and 52 are both closed and in this way the energization of the drive motor 31 is effected by at least either one of the first and second relays 51 and 52 even if a fault occurs in one or the other of them. It is to be noted that the danger of the first and second relays 51 and 52 simultaneously failing to effect the energization due to their contact failure or the like is quite rare and the driver is in effect allowed to make an evacuation running in the previously mentioned manner. In addition, where a fault is caused by the fact that either one of the first and second relays 51 and 52 remains closed thus failing to open, the energization of the drive motor 13 is effected by use of the three brushes 34, 35 and 36 through both of the relays 51 and 52. In this case, the resulting rotational speed of the drive motor 31 becomes substantially intermediary between the rotational speed obtained by energizing it by use of the first and second brushes 34 and 35 and the rotational speed obtained by energizing it by use of the first and third brushes 34 and 36, with the result that also in such a case the vehicle is allowed to make an evacuation running.

On the other hand, if the decision of the step 201 results in Ne=0 rpm so that a transfer is made to a step 209, whether the following condition holds or not is determined at the step 209

$$V_A \leqq 1 \text{ V and } V_B \leqq 1 \text{ V}$$

This is done for the purpose of checking the condition of the energizing circuit 50 including the first and second relays 51 and 52 when the engine 1 is not in operation. As a result, the pressure of no fault is determined when the above condition is satisfied and the presence of a fault is determined when the above condition is not satisfied.

When the presence of no fault is determined, all of the following steps are bypassed and the processing is ended. When the presence of a fault is determined, the same operation as the step 206 is performed at a step 210 and also the same operation as the step 207 is performed at a step 211, thereby informing the driver of the occurrence of the fault.

Thus, the above-mentioned embodiment is so designed that with the engine 1 in operation, the drive motor 31 is energized through the first and second relays 51 and 52 which are turned on and off contrary to each other in accordance with the operating condition (the load condition Q/Ne) of the engine 1, so that when a fault occurs in the energizing circuit 50 including the first and second relays 51 and 52, both of the first and second relays 51 and 52 are turned on. Moreover, since the danger of the first and second relays 51 and 52 simultaneously failing to effect the energization is quite rare, the energization of the drive motor 31 by at least either one of the first and second relays 51 and 52 is ensured and the minimum operation of the fuel pump 13 is ensured, thereby allowing the vehicle to make an evacuation running.

While, in the above-described embodiment, the load condition is discriminated on the basis of Q/Ne, it is possible to effect the discrimination between the low and intermediate loads and the high load in accordance with the positions of the throttle valve 5. For instance, the determination of the low and intermediate loads is made when it is determined that the throttle valve 5 is smaller than a given opening in accordance with the position signal from the position sensor 8, whereas the load is determined high when it is determined that the throttle valve 5 is greater than the given opening in accordance with the position signal from the position sensor 8.

Moreover, where the warm-up condition of the engine 1 is taken into consideration, the reference level for discrimination between the low and intermediate loads and the high load may be varied in accordance with the water temperature signal from the water temperature sensor 9.

We claim:

1. A fuel pump driving apparatus for an engine having a fuel pump, said apparatus comprising:

a pump drive motor having an armature, first and second brushes arranged to oppose each other through said armature and a third brush arranged separately from said first and second brushes, wherein said first brush is grounded;

a power source connected to at least one of said first to third brushes;

first and second switch members for connecting said second and third brushes respectively through first and second switch members to said power source;

means for detecting a load condition of said engine;

first current drawing means for drawing electric current to said armature of said motor through two of said first to third brushes;

second current drawing means for drawing electric current to said armature of said motor through all of said first to third brushes; and means for switching enabling and disabling of said first and second current drawing means in response to the detected load condition of said engine, wherein said switching means controls to close said first switch member and to open said second switch member when said load condition detecting means detects a low load condition, and wherein said switching means controls to open said first switch member and to close said second switch member when said load condition detecting means detects a high load condition, and wherein said switching means controls to close both of said first and second switch members when said load condition detecting means detects an intermediate load condition.

2. A fuel pump driving apparatus for an engine having a fuel pump, said apparatus comprising:

a pump drive motor having an armature, first and second brushes arranged to oppose each other through said armature and a third brush arranged separately from said first and second brushes, said first brush being connected to ground;

a power source;

a third switch member and a fourth switch member connecting said second brush to said power source, said third brush being connected to said power source through said fourth switch member, and said fourth switch member always being closed during operation of said engine, first current drawing means for drawing electric current to said armature of said motor through two of said first to third brushes;

second current drawing means for drawing electric current to said armature of said motor through all of said first to third brushes; and means for switching enabling and disabling of said first and second current drawing means in response to the detected load condition of said engine, wherein said switching means controls to open said third switch member when said load condition detecting means detects a high load condition and otherwise to close said third switch member.

3. A fuel pump driving apparatus for a vehicle engine comprising:

a fuel pump for forcing fuel in a fuel tank to fuel injection valves of said vehicle engine;

a drive motor having a first brush connected to the ground and second and third brushes connected to a power source and adapted to drive said fuel pump;

first switch means connected between said second brush and said power source;

second switch means connected in parallel with said first switch means between said third brush and said power source;

control means for controlling said first and second switch means;

first fault detecting means for detecting a fault in a first energizing line including said first switch means and said second brush; and second fault detecting means for detecting a fault in a second energizing line including said second switch means and said third brush, said control means controlling both of said first and second switch means to close when a fault is detected by either one of said first and second fault detecting means.

4. A fuel pump driving apparatus for a vehicle engine comprising:

a fuel pump for forcing fuel in a fuel tank to fuel injection valves of said vehicle engine;

a drive motor having a first brush connected to the ground and second and third brushes connected to a power source and adapted to drive said fuel pump;

first switch means connected between said second brush and said power source;

second switch means connected in parallel with said first switch means between said third brush and said power source;

first detecting means for detecting a terminal voltage applied to said second brush;

second detecting means for detecting a terminal voltage applied to said third brush;

first drive means for driving said first switch means;

second drive means for driving said second switch means in opposition to said first switch means;

discriminating means for determining that there is no fault when the terminal voltage of said second brush detected by said first detecting means is greater than a predetermined value and the terminal voltage of said third brush detected by said second detecting means is smaller than said predetermined value under a condition where said first switch means is closed by said first drive means and said second switch means is opened by said second drive means as well as when the terminal voltage of said second brush detected by said first detecting means is smaller than said predetermined value and the terminal voltage of said third brush detected by said second detecting means is greater than said predetermined value under a condition where said first switch means is opened by said first drive means and said second switch means is closed by said second drive means and for determining that there is a fault in other circumstances;

warning means whereby when the occurrence of a fault is determined by said discriminating means, a driver of said vehicle is informed of said fault; and faulty-condition control means whereby when the occurrence of a fault is determined by said discriminating means, said first and second drive means are controlled in such a manner that said drive motor is energized through at least either one of said first and second switch means.

5. A motor driving apparatus comprising:

a motor having an armature, first and second brushes arranged to oppose each other through said armature and a third brush arranged separately from said first and second brushes;

a power source connected to at least one of said first to third brushes;

first current supply means for supplying electric current through said first brush and said second brush to said armature of said motor;

second current supply means for supplying electric current through either one of said first brush and said second brush, and through said third brush, to said armature of said motor;

third current supply means for supplying electric current through all said first, second and third brushes to said armature of said motor; and switch means for switching to selectively enable and disable said first, second and third current supply means to thereby selectively generate any one of three-stepped motor driving speeds corresponding to said first, second and third current supply means.

* * * * *